US008752460B2

(12) United States Patent
Kroeger

(10) Patent No.: US 8,752,460 B2
(45) Date of Patent: Jun. 17, 2014

(54) NEEDLE ROLLER

(75) Inventor: Thorsten Kroeger, Rahden (DE)

(73) Assignee: Windmoeller & Hoelscher KG, Lengerich (DE)

( * ) Notice: Subject to any disclaimer, the term of this patent is extended or adjusted under 35 U.S.C. 154(b) by 0 days.

(21) Appl. No.: 12/736,384

(22) PCT Filed: Apr. 7, 2009

(86) PCT No.: PCT/EP2009/054138

§ 371 (c)(1),
(2), (4) Date: Dec. 10, 2010

(87) PCT Pub. No.: WO2009/124930

PCT Pub. Date: Oct. 15, 2009

(65) Prior Publication Data

US 2011/0100176 A1 May 5, 2011

(30) Foreign Application Priority Data

Apr. 7, 2008 (DE) ..... 10 2008 017 726

(51) Int. Cl.

| | |
|---|---|
| ***B26F 1/24*** | (2006.01) |
| ***B26F 1/02*** | (2006.01) |
| ***B31B 19/14*** | (2006.01) |
| ***B31B 23/00*** | (2006.01) |
| ***B31B 19/60*** | (2006.01) |
| ***B26F 1/04*** | (2006.01) |

(52) U.S. Cl.

CPC ..... *B26F 1/24* (2013.01); *B31B 2237/10* (2013.01); *B31B 2237/403* (2013.01); *B31B 2219/14* (2013.01); *B31B 2219/29* (2013.01); *B31B 19/14* (2013.01); *B31B 23/00* (2013.01); *B31B 19/60* (2013.01); *B26F 1/04* (2013.01)

USPC ..... 83/30; 83/113

(58) Field of Classification Search

USPC ..... 83/30, 113, 345, 348, 670, 677, 699, 83/690, 691, 338, 625, 698.61, 304, 305, 83/549, 32, 79.6, 346.388, 76.9, 698.71; 234/50; 270/58

See application file for complete search history.

(56) References Cited

U.S. PATENT DOCUMENTS

| | | | | |
|---|---|---|---|---|
| 3,355,974 | A | 12/1967 | Carmichael | |
| 3,683,736 | A * | 8/1972 | Loose | 83/16 |
| 3,877,353 | A * | 4/1975 | Smith et al. | 493/373 |
| 4,055,101 | A | 10/1977 | Collins | |
| 4,213,363 | A * | 7/1980 | Granger | 83/298 |
| 4,594,926 | A | 6/1986 | Propheter | |
| 5,802,945 | A | 9/1998 | Brinkmeier et al. | |
| 7,182,010 | B2 * | 2/2007 | Blank et al. | 83/338 |
| 2003/0033916 | A1 | 2/2003 | Blank et al. | |
| 2006/0283419 | A1 * | 12/2006 | Mihailescu | 123/204 |

FOREIGN PATENT DOCUMENTS

| | | | | |
|---|---|---|---|---|
| EP | 0 776 741 | A1 | 6/1997 | |
| FR | 2 460 776 | A1 | 1/1981 | |
| FR | 2 553 702 | A1 | 4/1985 | |
| JP | 7 256596 | A | 10/1995 | |
| JP | 2008138782 | A * | 6/2008 | F16C 13/00 |
| WO | WO 01/32370 | A1 | 5/2001 | |

* cited by examiner

*Primary Examiner* — Ghassem Alie
(74) *Attorney, Agent, or Firm* — Jacobson Holman, PLLC.

(57) ABSTRACT

A needle roll for perforation or pickup of material pieces or webs includes a needle roll body and needles. The needles protrude beyond the outer surface of the needle roll body for perforation into the material pieces or webs. The material roll body is mounted to rotate in a machine frame. The needles are movable relative to the needle roll body.

12 Claims, 3 Drawing Sheets

NEEDLE ROLLER

CROSS-REFERENCE TO RELATED APPLICATION

This is a national stage of PCT/EP09/054138 filed Apr. 7, 2009 and published in German, which has a priority of German no. 10 2008 017 726.1 filed Apr. 7, 2008, hereby incorporated by reference.

BACKGROUND OF THE INVENTION

1. Field of Invention

The invention concerns a needle roll for perforation or pickup of material pieces or webs as described herein, as well as a method for perforation or pickup of material pieces or webs that employs the aforementioned needle roll.

2. Description of the Prior Art

Needle rolls are often used to perforate material webs, for example, paper webs, from which tube pieces and ultimately sacks or bags are produced. Such perforations are often produced, in order to be able to vent such sacks after filling. The same also applies for bags, in which, say, bread is packed. The perforations so produced serve here to release moisture. A device including such needle rolls is described in EP 0 776 741 A1. Printed products are often provided with perforations, as is disclosed in U.S. Pat. No. 4,055,101.

However, needle rolls are also used to pick up material pieces, when a separate material piece is to be removed from the material flow. One application is the removal of so-called flaps, i.e., material pieces, during production of paper bags from web-like paper.

All the mentioned needle rolls are mounted to rotate in the machine frame or other components that are kept fixed during operation (for simplicity, only "machine frame" will be at issue below). The peripheral speed in some applications is the same as the transport speed in the material webs or pieces and in other applications, the peripheral speed of the needle rolls can differ from the transport speed. The needle rolls can have different variants. All variants have the common feature, however, of a needle roll body that can roll on the material web with its outside periphery.

Regardless of the application, the needles for piercing the material piece or material web protrude beyond the outer surface of the needle roll body.

A commonly occurring problem in needle rolls is loosening of the material piece or web after puncturing. For example, during perforation of webs, the needles and the web should loosen from each other again, without the needles having an effect on web tension. During removal of a material piece from the material flow, the problem often occurs that this material piece, after pickup by the needle roll, must also be removed from it again, so that the needle roll can pick up a new material piece again during the next revolution.

SUMMARY OF THE INVENTION

The underlying task of the present invention is therefore to propose a needle roll and a method, in which the needles and the material piece or web can be separated from each other in simple fashion.

The task is solved by a needle roll that includes the features described herein, and by a method that employs the aforementioned needle roll.

It is therefore proposed that the needle's be movable relative to the needle roll body. In particular, it is proposed to partially or fully retract the needles into the needle roll body after pickup of the material piece, so that the material piece lies on the outer surface of the needle roll body and is completely or at least largely stripped from the needles by this surface. A material piece that was entrained by the needle roll can now be collected in a waste container or removed by another device, like a suction device. The needles during this process should have reassumed their initial position after one complete revolution of the needle roll. The action of the device according to the invention is then particularly large, when the needles during this revolution are completely retracted once into the needle roll body ("low point") and have once reached their maximum position, i.e., the "high point" (greatest possible distance of the needle tips from the outer periphery of the needle roll body). However, it is also conceivable that the needles have twice reached the described positions in each revolution.

In an advantageous variant of the invention, at least one needle beam is provided, on which several needles are arranged. This needle beam then extends parallel to the axis of rotation of the needle roll. Through a number of needles, it is more reliably possible to pick up a material piece without it sliding undesirably from the needles again. If only one needle beam is used, it is possible in a simple manner to move this number of needles relative to the needle roll body.

It is also particularly advantageous, if a needle support is provided, which carries the needles or at least a needle beam. The needle support also advantageously extends parallel to the axis of rotation of the needle roll. The needle support is then movable in the radial direction of the needle roll. It is then advantageous, if the needle support can move on a sectional plane that is spanned by the rotational axis of the needle roll and a radial direction. The needle support can be guided here by guides, especially linear guide elements, like rails or sliding surfaces. If needles are now arranged on both sides of the needle support parallel to the guides, one needle set can reach its high point, while the other needle set can reach its low point and vice versa. With such an embodiment of the needle roll, two material pieces can therefore be taken up from the material flow by movement of only one assembly.

In a particularly advantageous embodiment of the invention, it is proposed that the at least one needle beam be releasably fastened to the needle support. This is prescribed, in particular, if two or more needle beams are provided on the needle support. One of the needle beams can be removed, so that only one material piece is picked up per revolution of the needle roll. During production of paper bags, this expedient has an advantageous effect, because bags of greater length, as are required, for example, to pack baguette breads, can be produced. The needle beams can be screwed onto the needle support. Other types of fastening are also conceivable.

In an advantageous modification of the invention, the needle beam has a pitch cam on at least one of the ends, in or on which a roll runs. This roll is fixed relative to the machine frame during rotation of the needle roll, so that rotation of the needle roll ensures movement of the needle support relative to the needle roll body. Instead of the roll, any equivalent element can be provided. The pitch cam is advantageously designed as a recess in the end of the needle support. However, the roll can also roll on a control or pitch cam that is not arranged, or at least not directly arranged on the needle support.

It is particularly advantageous, if the pitch cam has the shape of an ellipse. It is then advantageous, if the semi-minor axis of the ellipse runs at essentially right angles to the movement direction of the needle support. No major changes in acting forces occur in this elliptical shape, so that the entire device can be operated with the lowest possible wear. In the combination of the mentioned elliptical shape of the pitch cam with the guide device of the needle support, the forces exerted by the roll and the guides act not only radially outward, but also radially inward. If the latter were not the case, springs would have to be used, whose restoring force, however, would be strongly limited. The mentioned combination is therefore a major advantage.

In a preferred modification of the invention, it is proposed that the already mentioned roll be arranged on a block. This block can be a cylindrical body. This block can be rotated relative to the needle roll and relative to the machine frame. This axis of rotation of the block is flush with the axis of rotation of the needle roll. It is advantageous if two such blocks are provided, specifically one on each end. The block can even be rotated during operation of the needle roll.

It is also advantageous, if the axis of rotation of the roll is arranged parallel, but eccentric to the axis of rotation of the block. If the block is now rotated relative to the machine frame, the position of the roll can therefore be changed relative to the machine frame. In this way, the angular position of the high point and low point relative to the machine frame can be altered. The entry angle or entry time of the needles into the material can thus be adjusted. The same applies for the release time. This adjustment can then even occur during operation of the needle roll. An adjustment of the setting to the desired or current machine speed or to the rotational speed of the needle roll is even conceivable.

In a preferred embodiment of the invention, a motor, preferably an electric motor, is provided, with which the mentioned block can be rotated. If two blocks are provided, it is advantageous to couple them appropriately, so that their rotation is synchronous. This can occur, for example, via a shaft provided with gears, whose gears act on gears of the blocks.

Other advantageous embodiments of the invention are apparent from the figures and the substantive description.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modification within the spirit and scope of the invention will become apparent to those skilled in the art from this detailed description.

Figure 1:
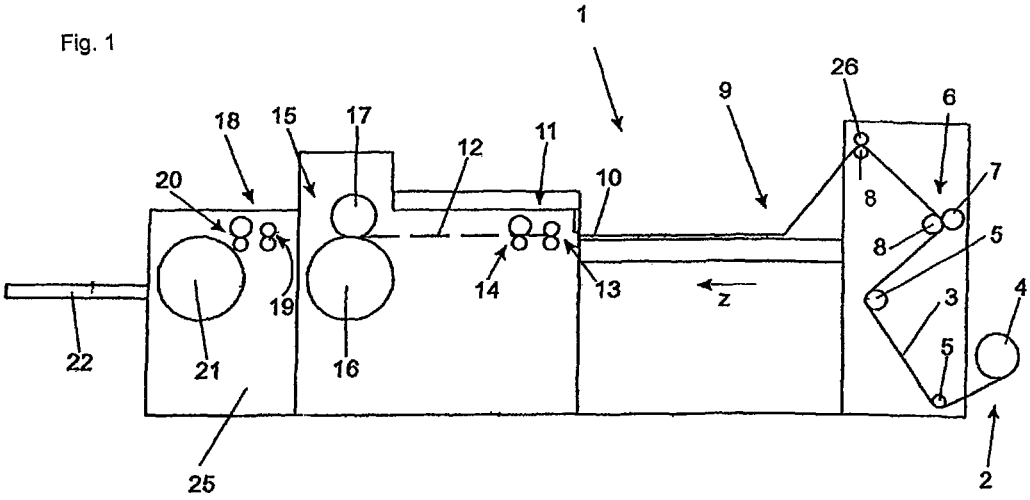
FIG. 1 side view of a first variant of a bag machine, in which the needle roll according to the invention can be advantageously used, FIG. 2 side view of a second variant of a bag machine, in which a needle roll according to the invention can advantageously be used, FIG. 3 detail view of a tear-off station, in which a needle roll according to the invention can advantageously be used, FIG. 4 longitudinal section through a needle roll according to the invention, FIG. 5 view V-V from FIG. 4, FIG. 6 needle roll from FIG. 4, but rotated by 90 degrees, FIG. 7 view VII-VII from FIG. 6.

FIG. 1 shows a device 1 for production of sacks. The essential components of this device are schematically depicted in this figure. The device 1 includes a winding device 2, to which a material web 3 in the form of a reel 4 is supplied. Starting from this reel 4, the web 3 is [passed] over guide rolls 5 to the cross-cutting station 6 or perforation station 6. This station 6 includes one or more cross-cutting or cross-perforating blades (not further shown), which revolve on a roll 7. The material web 3 runs in this station 6 over a counter-pressure roll 8, which mostly has the task of providing the necessary counter-pressure for the cutting or perforation process. The web is not perforated in this cutting or perforation process, but provided with weakening cuts or perforations, along which the tube to be formed later tears for separation into tube pieces. The perforations for a later tear-off of the material sections are also introduced to the material web in the described station 6. For this purpose, the roll 7 has blades in certain areas that are arranged parallel to each other.

The material web 3 then passes through a roll gap, that of an additional guide roll 5 and a roll designed as longitudinal gluing 26.

It applies glue to a side area of the material web 3, so that both side areas, after tube formation, which is described below, are permanently joined to each other.

In the subsequent tube formation station 9, a tube 10 is formed from material web 3, in which the web 3 is folded laterally by means of guide elements, like guide plates, so that the edges of the material web then overlap. The overlapping areas were already provided with an appropriate adhesive by means of longitudinal gluing 26. During folding of the paper web, side folds can also be made. However, insertion of the side folds can also occur after tube formation. The tube 10 is now generally conveyed in transport direction z.

After the tube 10 has been produced, it is separated into tube pieces 12 in the first tear-off station 11. For this purpose, the tube 10 is guided through the roll gap of a first roll pair 13. During further advance of the tube, it reaches the roll gap of a second roll pair 14. The rolls of the second roll pair continuously or at least temporarily have a greater peripheral speed than the rolls of the first roll pair 13, whose peripheral speed advantageously coincides with the transport speed of tube 10. If the next perforation, viewed from the leading end of the tube, has passed the roll gap of the first roll pair 13, the second roll pair 14 engages on tube 10. This can occur by the leading end of the tube entering the roll gap of the second roll pair. The rolls of the second roll pair 14, however, can also be moved relative (for example, perpendicular) to tube 10 and are positioned on the tube. When the rolls of the second roll gap 14 lie against the tube, the tube tears along the cut or perforation that was introduced to the web in station 6.

The tube piece 12, torn off from the tube, now goes to the bottom gluing and bottom folding station 15. For this purpose, the tube piece 12 is fixed on the bottoming cylinder 16. Through an appropriate element, for example, a rod, the leading tab of the tube piece, which is generally a component of the bottom and protrudes above the top, is folded, so that parts of the lower layer, after folding, lie on the outside of the upper layer. Beforehand, the tab and/or area of the outside of the upper layer, on which the tab lies after folding, is provided with an adhesive, for example, glue. For this purpose, the glue application device is used, which is symbolized in FIG. 1 by the glue cylinder 17.

After the bag has been finished to this extent, it passes through a second tear-off station 18. This tear-off station 18 is therefore arranged after the glue cylinder 17. This station is designed, in principle, like the first tear-off station 11 and operates similarly. The spacings of the two roll gaps are set, so that the roll gap of roll pair 19 only grasps the material section of the upper layer that extends beyond the lower layer, while the roll pair 20 ensures accelerated further transport of the bag. This material section is then taken off by the needle roll according to the invention. After tear-off of said material section, the bag is placed by means of a placing cylinder 21 on a table 22. The bags are then generally arranged vertically upright. The bags can then be appropriately removed and stacked from this table 22.

Figure 2:
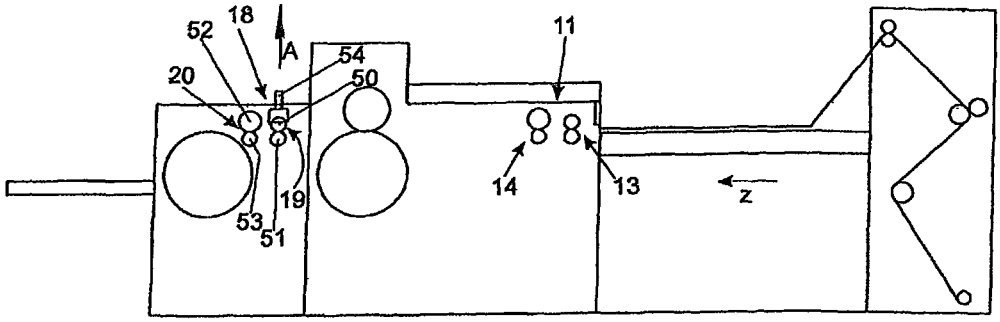

FIG. 2 again shows the device according to FIG. 1. In comparison to FIG. 1, the rolls of the roll pairs 19 and 20 are now provided with reference numbers. The roll 50 of roll pair 19 is then designed as a needle roll, as is further explained in FIG. 3. The roll 51 is laid out accordingly as a counter-pressure roll, which can include recesses, into which the needles can enter. These recesses can be designed hole-like or as grooves. A stripping device, designed as a suction device, is provided above the needle roll 50, which has the purpose of removing a material section taken up in the roll gap by needle roll 50 from the needle roll 50.

Figure 3:
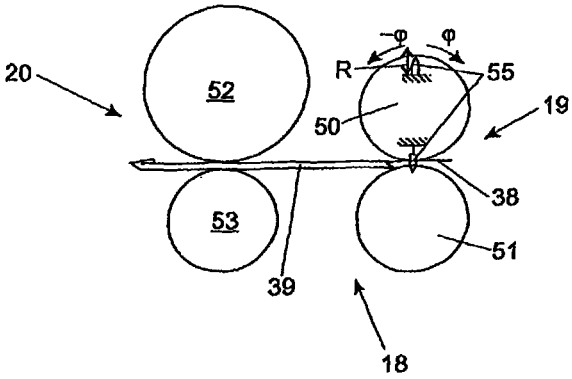

FIG. 3 shows the roll pairs 19 and 20 of the second tear-off station 18 in an enlarged view. The roll 50 of roll pair 19 is equipped with needles 55, two of which can be seen. These needles 55 are mounted to move within roll 50 and are deployed from the peripheral surface of roll 50 right before or when they reach the counter-pressure roll 51. At this moment, the material section 38 should be grasped. Tear-off of the material section 38 occurs either by holding with needles 55, or owing to the fact that the material section is held in the gap of rolls 50 and 51 or by both. If, after further rotation of roll 50, the material section has reached the area of the suction device 54 (not shown here), the needles 55 can be retracted again into the body of roll 50, so that suction of the material section is facilitated. Deployment and retraction of the needles can occur, for example, by a guide surface (not shown). For this purpose, the needles can be spring-loaded, so that they are situated within the roll body in the base position. For deployment of the needles, they can then run over a guide surface, arranged so that the needles are forced outward against the spring force. However, the needles can also be moved in a different way in the direction of double arrow R, which shows the radial direction of roll 50. For example, controllable pneumatic cylinders are conceivable.

While needles 55 grasp of the material section 38, the bag 39 is already situated in the gap between rolls 52 and 53. The peripheral speed of these rolls is essentially the same as the transport speed, with which the bags or tube pieces are transported through the device. The peripheral speed of rolls 50 and 51, at least in the period between grasping of the material section 38 and tear-off, is smaller than this transport speed, in order to permit tear-off. However, since the average peripheral speed, i.e., the path after a complete revolution of roll 50 divided by the corresponding time, must be equal to the transport speed, the roll 50 must be driven non-uniformly, i.e., with non-uniform angular or peripheral speed. This can occur, for example, via a known non-uniformity gear mechanism or a separate servo motor.

The phase position of rolls 50 is adjustable in the direction of arrows $\phi$ and $-\phi$, in order to be able to process two pieces or bags of different formats.

Figure 4:
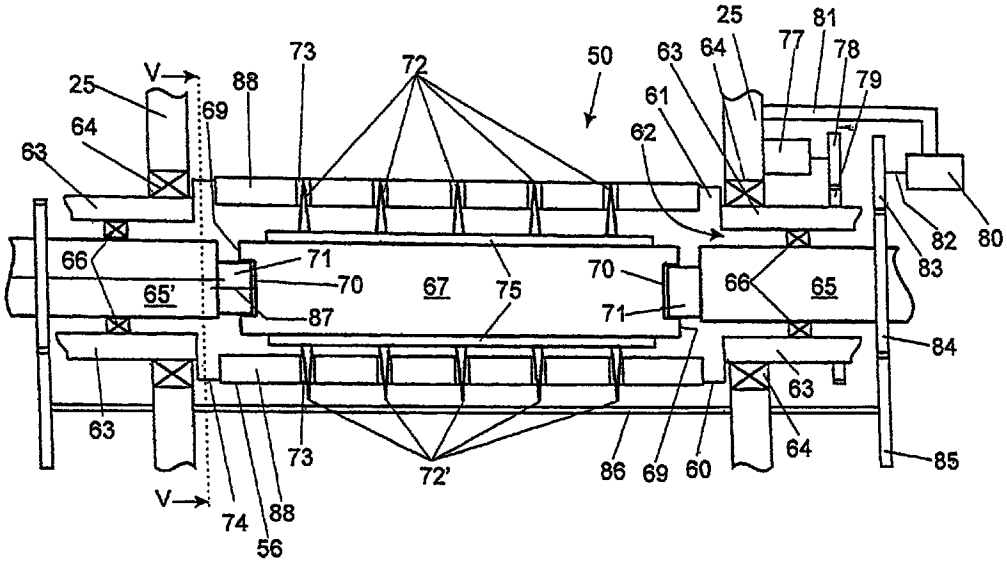

FIG. 4 shows a preferred variant of a needle roll 50, and especially control of movement of the needles within this needle roll.

The needle roll 50 initially includes a cylinder body 60, which is designed as a hollow cylinder and has a central opening 62 on each of its ends 61. On the outside, another hollow cylinder 63 is fastened to each end. The cylinder body 60 and/or, as shown in FIG. 4, the hollow cylinder 63 are mounted to rotate via bearing 64 in the machine frame 25. At least one of the hollow cylinders 63 can be acted upon by a drive with a torque. The drive, for example, can act on a toothed belt, which transfers the drive torque to the hollow cylinder 63 by means of gears, which therefore functions as a shaft. The hollow cylinder 63, however, can also be driven by its own motor. The drive arrangement can be gearless. As an example, the arrangement depicted in FIG. 4 is described: the electric motor 77 arranged on the machine frame drives a gear 78, which meshes with the drive gear 79 fastened to the hollow cylinder 63.

Another cylinder 65 passes through both hollow cylinder 63 and the central opening 62 and therefore extends into the internal space of cylinder body 60. The hollow cylinder 63 can be supported on cylinder 65 via bearing 66. This cylinder 65 can be fastened to parts of the machine frame 25, not further shown, but can also be rotated relative to them. This rotational capability, as described further below, serves to adjust the needles relative to the outer surface of cylinder body 60.

Figure 5:
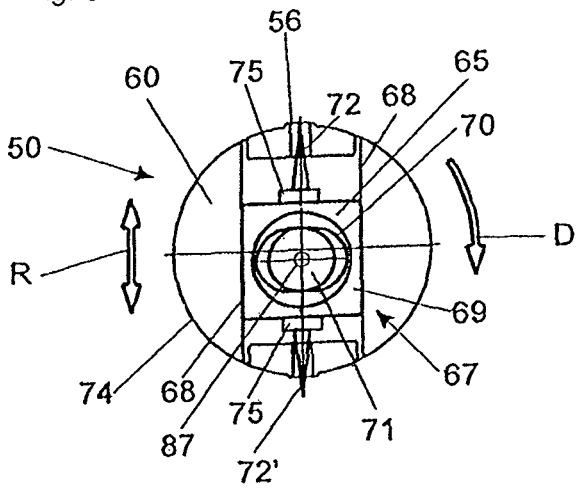

A needle support 67 is mounted to move in cylinder body 60 in guide 68, so that it can be moved in the direction of double arrow R relative to the cylinder body 60 (see FIG. 5). The guides 68 in the practical example depicted in FIG. 5 consist of two plane-parallel planes that represent sliding planes for the needle support. However, they can be designed differently, in principle, as long as they permit movement of the needle support 67 in the direction of double arrow R. The needle support 67 carries a needle beam 75 on each of its two side surfaces, which each carry a series of needle beam needles 72 that can engage through holes 73. The holes are made in a closure beam 88. This closure beam 88 represents an elevation 56 relative to the outside surface 74, which ensures that the material section can be torn off from the bag. In this case, needle rolls and counter-pressure rolls 51 do not have continuous contact and do not fix the material section. If, however, the elevation 56 passes the counter-pressure roll, the material section is firmly gripped and therefore torn from the sack, while the section is simultaneously taken up by the needles.

The closure beam 88 can be releasably fastened to the cylinder body 60 by means of appropriate fastening devices, like screws. The needle beam 75 can also be fastened with screws 76 (see FIG. 6) to needle support 67. The needle beams can therefore be simply removed. The recess of the outer surface 74 forming on this account can now be closed by a cover (not shown). The needle roll 50 then operates with only one needle beam and removes only one material section 38 per revolution (normally two). The needle roll is therefore adaptable to the particularly large lengths of bag 39.

The needle support 67 has elliptical recesses 70 on the ends 69. Rolls 71 engage in these elliptical recesses 70, which are fastened on the end of cylinder 65 facing the needle support 67, the axis of rotation 87 of roll 71 not being flush with the axis of cylinder 65, but arranged eccentric to it. The roll can be arranged to rotate on cylinder 65.

Figure 6:
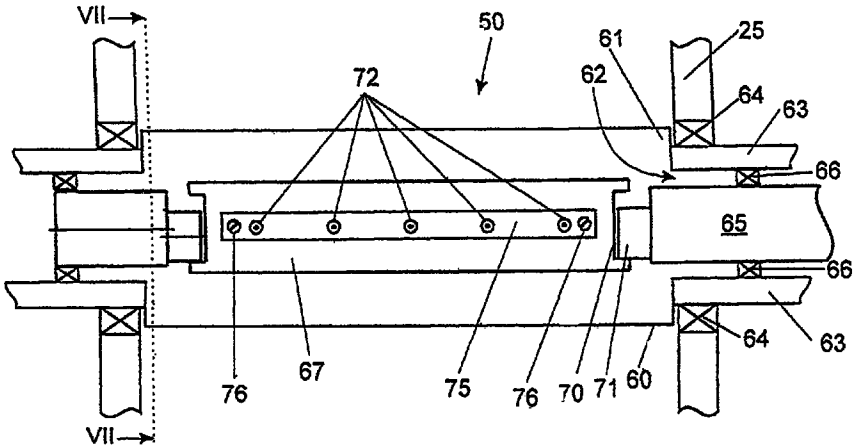

Only the first right end of the needle roll 50 has thus far been described with reference to FIG. 4. The second left end is designed similarly. However, devices for exposure of the roll to a torque can be omitted here. FIG. 6 shows the same roll 50 as in FIG. 4, but rotated further by an angle of 90°.

The function of needle roll 50 can be explained with reference to FIGS. 5 and 7. In the initial position, the upper needle beam needles 72, which are situated in the so-called "12 o'clock position," are lowered within cylinder body 60. The lower needle beam needles 72' ("6 o'clock position"), on the other hand, are deployed as far as possible and then extend beyond the outer surface 74 of cylinder body 60. In this position, the needle beam needles 72' are capable of grasping a material section 38. If the cylinder body 60 is now placed in rotation according to arrow D, the roll 71 remains, as described, in its position. The elliptical recess 70, however, rolls with the end surfaces on roll 71. Since the needle support is not freely movable, but can only be moved in the direction of arrow R, the needle support 67 is acted upon by roll 71 on the edge surfaces of the elliptical recess 70 with a resulting force that points in direction R.

Figure 7:
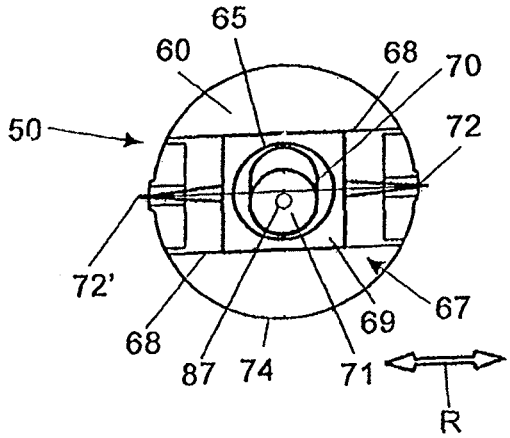

The situation after one-quarter rotation (rotation by 90°) is shown in FIG. 7. The main axis of inertia of needle support 67 is now situated on the axis of rotation of cylinder body 67. The needle beam needles 72 and the needle beam needles 72' therefore protrude equally far from the cylinder body. During subsequent rotation, needle beam needles 72' are retracted increasingly farther into the cylinder body, so that a material section that is held by the needle beam needles 72' on the peripheral surface of the cylinder body is released again. Complete release of the material section occurs, for example, in the area of the suction device 54 (not shown here), so that the material section can be reliably removed from the second separation station.

In order to be able to change the angular position, in which the needle beam needles 72 and 72' are deployed as far as possible in direction ϕ or −ϕ (see FIG. 3), the cylinders 65, 65' can now be rotated relative to the machine frame. This is even possible during an operation of the device according to the invention. With rotation of cylinder 65, the axis of rotation 87 of roll 71 is also pivoted around the same angular amount, which means that the position, in which needle beam needles 72 and 72' are deployed as far as possible, is also altered by this angle amount. If, for example, the cylinder 65 is rotated counter-clockwise by 30°, the position, in which needle beam needles 72 and 72' can be deployed as far as possible, is changed to the so-called 5 o'clock position. A drive 80, for example, a servo motor, is provided for rotation of cylinders 65 and 65', which is fastened to machine frame 25 by appropriate holders 81. The shaft 82 of drive 80 carries a gear 83, which meshes with a drive gear 84 arranged on cylinder 65. The drive gear 84 again drives another gear 85, this a control shaft 86 and the latter again a gear 85'. Gear 85' meshes with the drive gear 84', which is fastened to cylinder 65'. If the cylinder 65 is now moved via the mentioned arrangement, the synchronization arrangement (gears 85, 85', shaft 86) ensures that the drive gear 84' and therefore cylinders 65' are equally adjusted. The mentioned synchronization arrangement is only shown as an example and other arrangements are equally conceivable. In particular, for cost reasons, motor adjustment can be dispensed with and manual adjustment by means of appropriate hand wheels or levers can be provided.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

| List of Reference Numbers | |
|---|---|
| 1 | Device for production of bags |
| 2 | Winding device |
| 3 | Material web |
| 4 | Reel |
| 5 | Guide roll |
| 6 | Cross-cutting station/perforation station |
| 7 | Roll |
| 8 | Counter-pressure roll |

-continued

| List of Reference Numbers | |
|---|---|
| 9 | Tube formation station |
| 10 | Tube |
| 11 | First tear-off station |
| 12 | Tube piece |
| 13 | First roll pair/holding roll pair |
| 14 | Second roll pair/tear-off roll pair |
| 15 | Bottom gluing and folding station |
| 16 | Bottoming cylinder |
| 17 | Glue cylinder/folding blade |
| 18 | Second tear-off station |
| 19 | Roll pair |
| 20 | Roll pair |
| 21 | Laying cylinder |
| 22 | Table |
| 23 | |
| 24 | |
| 25 | Machine frame of second tear-off station |
| 26 | Longitudinal gluing |
| 27 | |
| 28 | |
| 29 | |
| 30 | |
| 31 | |
| 32, 32' | |
| 33 | |
| 34 | |
| 35 | |
| 36 | |
| 37 | |
| 38 | Material section |
| 39 | Bag |
| 50 | Needle roll |
| 51 | Counter-pressure roll |
| 52 | Tension roll |
| 53 | Counter-pressure roll |
| 54 | Suction device |
| 55 | Needles |
| 56 | Elevation |
| 57 | |
| 58 | |
| 59 | |
| 60 | Cylinder body |
| 61 | End surfaces |
| 62 | Central opening |
| 63 | Hollow cylinder |
| 64 | Bearing |
| 65, 65' | Cylinder |
| 66 | Bearing |
| 67 | Needle support |
| 68 | Guide |
| 69 | End of needle support 67 |
| 70 | Elliptical recess |
| 71 | Rolls |
| 72, 72' | Needles |
| 73 | Hole |
| 74 | Outer surface |
| 75 | Needle beam |
| 76 | Screw |
| 77 | Electric motor |
| 78 | Gear |
| 79 | Drive gear |
| 80 | Drive |
| 81 | Holder |
| 82 | Shaft |
| 83 | Gear |
| 84 | Drive gear |
| 85, 85' | Additional gear |
| 86 | Control shaft |
| 87 | Rotational axis of roll 71 |
| 88 | Closure beam |
| z | Transport direction of tube |
| A | Suction direction |
| ϕ | Peripheral direction |
| R | Radial direction; displacement direction of needle support 67 |
| D | Direction of rotation of cylinder body 60 |

What is claimed is:

1. A method for perforation or pickup of material pieces or webs with a needle roll that includes a needle roll body mounted to rotate in a machine frame; needles that are movable relative to the needle roll body as the needle roll body rotates so as to be able to protrude beyond an outer surface of the needle roll body and perforate the material pieces or webs, and so as to be able to partially or fully retract therefrom into the needle roll body so that the perforated material pieced or webs is substantially removed from the needles and lies on the outer surface of the needle roll body; and a needle support that houses the needles, the needle support extending in a. direction parallel to an axis of rotation of the needle roll, being movable in a radial direction (R) of the needle roll, and having a pitch cam on at least one end thereof in which a roll rotates, said method comprising:

rotating the needle roll body relative to the machine frame so as to (i) perforate or pick up the material pieces or webs with the needles in a protruded position and (ii) substantially remove the material pieces or webs from the needles as the needles return to a retracted position.

2. The method according to claim 1, wherein the needles complete movement from the retracted position to the protruded position and return to the retracted position least once during a revolution of the needle roll.

3. The method according to claim 1, wherein the needle support moves in the radial direction (R) of the needle roll so as to enable the needles to protrude beyond the outer surface of the needle roll body.

4. A needle roll for perforation or pickup of material pieces or webs, comprising:

a needle roll body mounted to rotate in a machine frame;

needles that are movable relative to the needle roll body as the needle roll body rotates so as to be able to protrude beyond an outer surface of the needle roll body and perforate the material pieces or webs, and so as to be able to partially or fully retract therefrom into the needle roll body so that the perforated material pieces or webs is substantially removed from he needles and lies on the outer surface of the needle roll body; and a needle support that houses the needles, the needle support extending in a direction. parallel, to an axis of rotation of the needle roll, being movable in a radial direction (R) of the needle roil, and having a pitch cam on at least one end thereof in which a roll rotates, said needles completing movement from a retracted position. to a protruded position and returning to the retracted position at least once during a revolution of the needle roll.

5. The needle roll according to claim 4, further comprising at least one needle beam associated with the needle support, the needle beam (i) extending parallel to the axis of rotation of the needle roll, (ii) having a plurality of needles arranged thereon, and (iii) being movable relative to the needle roll body.

6. The needle roll according to claim 5, wherein the needle beam is releasably fastened to the needle support.

7. The needle roll according to claim 4, wherein the roll is arranged on a block that is rotatable relative to the needle roll and relative to the machine frame, with an axis of rotation of the block being parallel to and aligned with the axis of rotation of the needle roll.

8. Needle roll according to the claim 7, wherein the axis of rotation of the roll is arranged parallel with, but eccentric to, the axis of rotation of the block.

9. The needle roll according to claim 7, further comprising a. motor that rotates the block.

10. The needle roll according to claim 9, wherein the motor is an electric motor.

11. The needle roll according to claim 4, wherein the pitch cam has a shape of an ellipse.

12. The needle roll according to claim 11, wherein a semi-minor axis of the ellipse extends at substantially a right angle to a movement direction of the needle support.

* * * * *